US009698492B2

(12) United States Patent
Rao et al.

(10) Patent No.: US 9,698,492 B2
(45) Date of Patent: Jul. 4, 2017

(54) LOW-COST DIPLEXED MULTIPLE BEAM INTEGRATED ANTENNA SYSTEM FOR LEO SATELLITE CONSTELLATION

(71) Applicant: NORTHROP GRUMMAN SYSTEMS CORPORATION, Falls Church, VA (US)

(72) Inventors: Sudhakar K. Rao, Rancho Palos Verdes, CA (US); Daniel H. Roper, Torrance, CA (US); Arun K. Bhattacharyya, Littleton, CO (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 347 days.

(21) Appl. No.: 14/608,070

(22) Filed: Jan. 28, 2015

(65) Prior Publication Data

US 2016/0218436 A1 Jul. 28, 2016

(51) Int. Cl.
*H01Q 15/24* (2006.01)
*H01Q 21/30* (2006.01)
(Continued)

(52) U.S. Cl.
CPC ..... *H01Q 15/244* (2013.01); *H01P 1/173* (2013.01); *H01P 1/2131* (2013.01);
(Continued)

(58) Field of Classification Search
CPC .... H01Q 21/064; H01Q 21/30; H01Q 15/244; H01Q 13/0241; H01Q 13/02; H01P 1/173; H01P 1/2138; H01P 1/2131; H01P 1/288
(Continued)

(56) References Cited

U.S. PATENT DOCUMENTS 4,467,294 A * 8/1984 Janky ..... H01P 1/161 333/126
5,305,001 A * 4/1994 Wong ..... H01Q 13/0258 333/21 A
(Continued)

OTHER PUBLICATIONS

Amyotte, Eric et al. "Recent Developments in KA-Band Satellite Antennas for Broadband Communications" 28th AIAA International Communications Satellite Systems Conference, (ICSSC-201) Aug. 30-Sep. 2, 2010 Anaheim, California, 5 pgs.
(Continued)

*Primary Examiner* — Dameon E Levi
*Assistant Examiner* — Ab Salam Alkassim, Jr.
(74) *Attorney, Agent, or Firm* — John A. Miller; Miller IP Group, PLC

(57) ABSTRACT

A multiple beam integrated antenna system for a satellite including a support structure having an alignment plate. The antenna system further includes a plurality of feed horns mounted to the alignment plate, where each feed horn includes a plurality of tapered sections that support propagation modes for both up-link signals and down-link signals. A septum polarizer is mounted to an input end of each feed horn that converts linearly polarized signals to circularly polarized signals for the up-link signals and converts circularly polarized signals to linearly polarized signals for the down-link signals. A Y-shaped waveguide is coupled to each of the polarizers and includes separate receive reject and transmit reject filters so as to keep the up-link signals and the down-link signals from interfering with each other. Flex waveguides couple the transmit leg and the receive leg of each Y-shaped waveguide to RF modules.

18 Claims, 3 Drawing Sheets

(51) Int. Cl.

| | |
|---|---|
| ***H01Q 13/02*** | (2006.01) |
| ***H01Q 1/28*** | (2006.01) |
| ***H01P 1/17*** | (2006.01) |
| ***H01P 1/213*** | (2006.01) |
| ***H01Q 21/06*** | (2006.01) |

(52) U.S. Cl.
CPC ..... *H01P 1/2138* (2013.01); *H01Q 1/288* (2013.01); *H01Q 13/02* (2013.01); *H01Q 13/0241* (2013.01); *H01Q 21/064* (2013.01); *H01Q 21/30* (2013.01)

(58) Field of Classification Search
USPC ..... 343/779, 786, 835
See application file for complete search history.

(56) References Cited

U.S. PATENT DOCUMENTS 5,517,203 A * 5/1996 Fiedziuszko ..... H01P 1/2086 333/202
5,548,292 A * 8/1996 Hirshfield ..... H01Q 1/288 342/354
5,755,406 A * 5/1998 Aston ..... B64G 1/1007 244/159.4
6,201,508 B1 * 3/2001 Metzen ..... H01Q 13/0258 343/776
6,271,799 B1 * 8/2001 Rief ..... H01Q 13/0258 343/776
6,384,795 B1 * 5/2002 Bhattacharyya ..... H01Q 1/288 343/772
6,388,634 B1 * 5/2002 Ramanujam ..... H01Q 1/288 343/781 P
6,424,312 B2 * 7/2002 Mangenot ..... H01Q 19/17 343/781 R
6,703,976 B2 * 3/2004 Jacomb-Hood ..... H01Q 1/288 342/373
6,781,555 B2 8/2004 Ramanujam et al.
6,961,025 B1 11/2005 Chethik et al.
6,985,118 B2 * 1/2006 Zarro ..... H01Q 13/02 333/137
7,110,716 B2 9/2006 Rao et al.
7,394,436 B2 * 7/2008 Rao ..... H01Q 19/17 343/780
7,868,840 B2 1/2011 Rao et al.
8,164,533 B1 4/2012 Hsu et al.
8,228,840 B2 7/2012 Skärby
8,552,917 B2 * 10/2013 Mathews ..... H01Q 1/288 343/779
9,112,279 B2 * 8/2015 Montgomery ..... H01Q 13/0275
9,246,225 B2 * 1/2016 Bilotti ..... H01P 1/2016
9,300,054 B2 * 3/2016 Martin ..... H01Q 1/38
2005/0104794 A1 * 5/2005 Rao ..... H01Q 3/2658 343/786
2009/0066598 A1 * 3/2009 Malstrom ..... H01Q 13/02 343/786
2009/0309801 A1 * 12/2009 Rao ..... H01Q 1/288 343/779
2010/0081373 A1 * 4/2010 Rao ..... H04B 7/18515 455/12.1
2011/0018758 A1 * 1/2011 Ecclestone ..... H01Q 1/002 342/352
2014/0022137 A1 * 1/2014 Bosshard ..... H01P 1/2131 343/835
2014/0022138 A1 * 1/2014 Bosshard ..... H01Q 1/288 343/836
2014/0071010 A1 * 3/2014 Pouyez ..... H01Q 13/02 343/779

OTHER PUBLICATIONS

Nathrath, N. et al. "Lightweight Intersatellitelink Antenna (LISA) Operating at KA-Band" Proceedings of the Fourth European Conference on Antennas and Propagation, Barcelona, Spain, Apr. 12-16, 2010. pp. 1-4.
Rao, Sudhakar K. et al., "Stepped-Reflector Antenna for Dual-Band Multiple Beam Satellite Communications Payloads" IEEE Transactions on Antennas and Propagation, vol. 54, No. 3, Mar. 2006.
Rao, Sudhakar K. "Parametric Design and Analysis of Multiple-Beam Reflector Antennas for Satellite Communications" IEEE Antennas and Propagation Magazine, vol. 45, No. 4, Aug. 2003.
Rao, Sudhakar K. "Design and Analysis of Multiple-Beam Reflector Antennas" IEEE Antenna and Propagation Magazine, vol. 41, No. 4, Aug. 1999.
Rudge, Alan W. "Multiple-Beam Antennas: Offset Reflectors with Offset Feeds" IEEE Transactions on Antennas and Propagation, vol. AP-23, No. 3, May 1975.

* cited by examiner

LOW-COST DIPLEXED MULTIPLE BEAM INTEGRATED ANTENNA SYSTEM FOR LEO SATELLITE CONSTELLATION

BACKGROUND

Field

This invention relates generally to a diplexed multiple beam integrated antenna system and, more particularly, to a diplexed multiple beam integrated antenna system for a low Earth orbit (LEO) satellite that includes feed horns having a profile that is optimized for both up-link and down-link signals.

Discussion

Recently, there has been a tremendous growth in the use of multiple-beam antenna (MBA) systems for satellite communications, such as direct-broadcast satellites (DBS), personal communications satellites (PCS), military communications satellites, high-speed Internet application satellites, etc. These MBA systems provide coverage to a specific geographical region on the Earth, either contiguously or non-contiguously, using a large number of spot beams that support both down-link (satellite-to-ground) and up-link (ground-to-satellite) frequency bands. The design objectives for MBA systems typically include maximizing a minimum gain over the coverage region, maximizing a pattern roll-off outside the spot-beam area, and minimizing side-lobe radiation in order to maximize frequency reuse. The main advantages of MBA systems over contoured beam payloads include increased spectral utilization achieved through the re-use of frequencies over several spot beams instead of using the whole spectrum on a single contoured beam, increased antenna gain due to a much smaller beam size resulting in higher effective isotropic radiated power (EIRP) on the down-link and higher gain-to-noise temperature (G/T) on the up-link, increased capacity, and smaller ground terminals.

MBA systems typically use either a single-aperture design with complex beam-forming networks, or multiple-aperture designs without beam-forming networks. These types of antennas typically use three-cell, four-cell or seven-cell frequency-reuse schemes in order to increase the effective bandwidth by several fold.

The design of single-aperture multiple-beam antennas has been described in the art using the known "basic-feed concept" and the "enhanced-feed concept." It has been shown that using overlapping feed clusters in the enhanced-feed concept can achieve good electrical performance through a complex beam-former that requires an element-sharing network and a beam-forming network. Multiple-aperture multiple-beam antennas have the benefits of hardware simplicity and better electrical performance as compared to single-aperture multiple-beam antennas, but at the expense of an increased number of apertures.

The above described MBA systems have been successfully used in the past for geo-synchronous satellites that support personal communications, direct-to-home broadcasts, military communications and mobile communications services. LEO satellite constellations require a large number of satellites arranged in various elliptical orbital planes, where a number of the satellites are placed in each of the orbital planes. The number of the LEO satellites required for global coverage ranges from tens to thousands depending on the altitude of the satellites. Each satellite is required to provide an up-link and down-link signal with the ground and requires a gateway and an inter-satellite link. The cost of the satellite grows with the complexity of the antenna system, where a typical communications link uses two separate antennas, one for the down-link and one for the up-link signal.

DETAILED DESCRIPTION OF THE EMBODIMENTS

The following discussion of the embodiments of the invention directed to a diplexed multiple beam integrated antenna system for a low Earth orbit (LEO) satellite is merely exemplary in nature, and is in no way intended to limit the invention or its applications or uses. As mentioned, the antenna system of the invention has particular application for an LEO satellite. However, as will be appreciated by those skilled in the art, the antenna system of the invention may have application for other types of satellites or other communications systems.

As will be discussed in detail below, the present invention proposes an integrated diplexed multi-beam antenna system for use on an LEO satellite, where the antenna system includes a plurality of antenna feed horns having a profile configured to efficiently propagate multi-mode signals over a wide bandwidth to accommodate both up-link and down-link communications signals.

Figure 1:
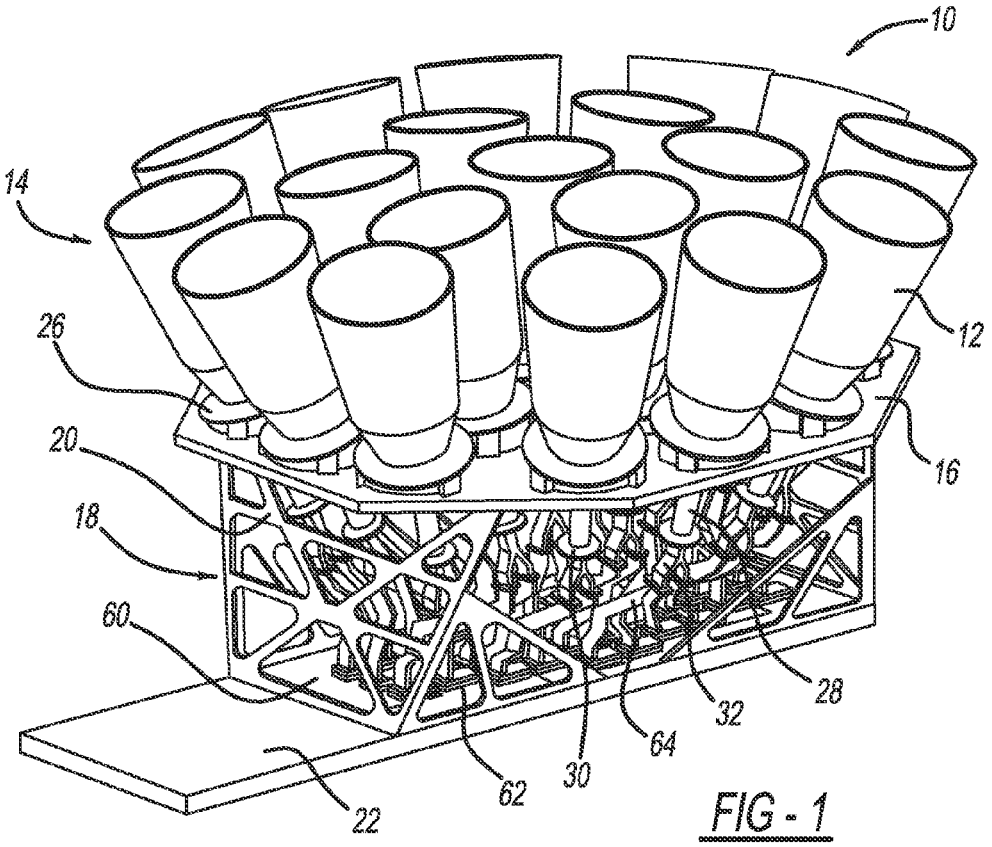
FIG. 1 is an isometric view of an integrated diplexed multi-beam antenna system mounted on a satellite body.

FIG. 1 is an isometric view of an integrated diplexed multi-beam antenna system 10 including a plurality of antenna feed horns 12 that are part of an antenna feed assembly 14. Each of the feed horns 12 is rigidly mounted to an alignment structure 16 at a particular angle using a mounting ring 26 so that the beam generated by a particular feed horn 12 is directed to a desired location or cell on the Earth. The alignment structure 16 is mounted to a mechanical support structure 18 including a configuration of support struts 20 defining an enclosure that is supported on a base plate 22 that represents the spacecraft or satellite body. The alignment structure 16, the mechanical support structure 18 and the base plate 22 can be made of any lightweight and strong material, such as die-cast aluminum, that is suitable for the space environment.

In this non-limiting example, the feed assembly 14 includes nineteen of the feed horns 12 that have an aperture size that accommodates the desired frequency band of interest for both the up-link and down-link signals, where the number of the feed horns 12 provides full coverage of the Earth from the perspective of the satellite at its particular orbital altitude. The feed horns 12 have an optimized profile selectively configured so that electromagnetic waves at the desired wavelengths effectively propagate multiple propagation modes for the frequency bands of both the up-link and the down-link signals. The antenna system 10 increases the down-link spectrum by a factor of 4.75 compared to known antenna systems by using nineteen multiple beams.

Figure 2:
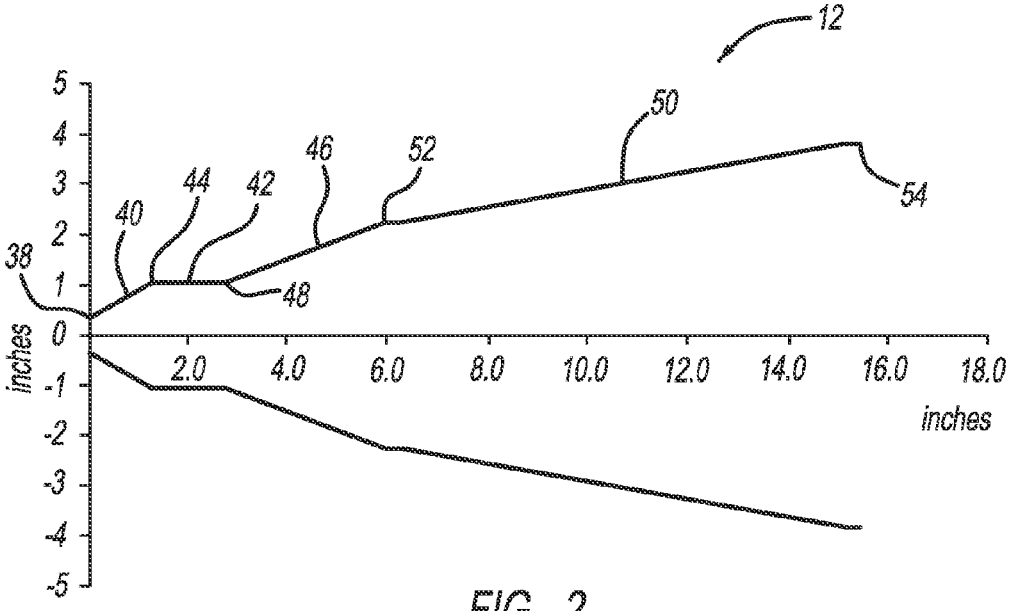
FIG. 2 is a profile view of one of the feed horns from the antenna system shown in FIG. 1.

FIG. 2 is a cross-sectional type view of one the feed horns 12 shown relative to a horizontal and vertical scale in inches. In this non-limiting design, the feed horn 12 includes an input end 38 having a diameter of 0.76 inches, a tapered input portion 40, a cylindrical portion 42 defining a transition 44 where it is coupled to the tapered portion 40, a tapered intermediate portion 46 defining a transition 48 where it is coupled to the cylindrical portion 42, and a long tapered output portion 50 defining a transition 52 where it is coupled to the tapered portion 46, where the output portion 50 has an output aperture 54 that defines an aperture diameter of 7.6 inches. This profile of the feed horn 12 allows propagation modes over a relatively wide bandwidth to accommodate both the up-link and down-link signals without the need to provide corrugations within the horn 12, which would otherwise add cost, complexity and weight to the feed horn.

Figure 3:
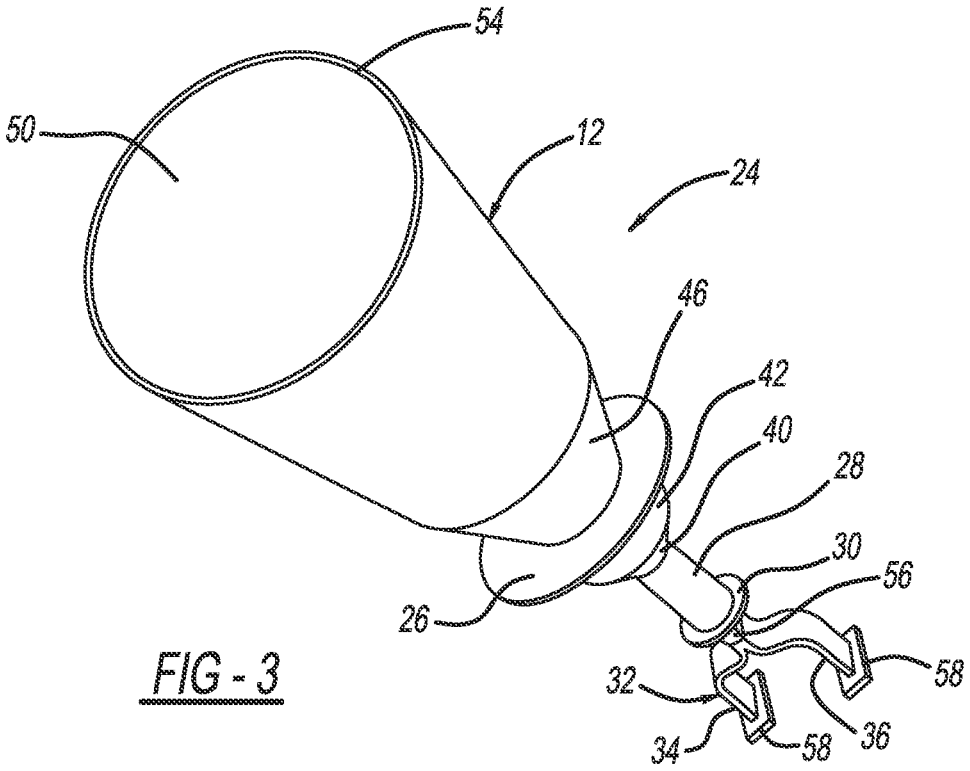
FIG. 3 is an isometric view of a feed horn assembly including one of the feed horns from the antenna system shown in FIG. 1.

FIG. 3 is an isometric view of a feed horn assembly 24 including one of the feed horns 12. In this embodiment, the antenna system 10 would include nineteen of the feed horn assemblies 24. The feed horn assembly 24 also includes a cylindrical septum polarizer 28 having one end formed to the input portion 40 of the feed horn 12, as shown. The shape of the septum polarizer 28 is configured to convert circularly polarized up-link signals received by the horn 12 to linearly polarized signals for processing in the receiver circuitry and to convert linearly polarized down-link signals from the transmitter circuitry to circularly polarized signals for transmission by the feed horn 12. The septum polarizer 28 is mounted to a Y-shaped waveguide 32 by mounting flanges 30 opposite to the feed horn 12. The waveguide 32 includes a transition polarizer port 56 coupled to the polarizer 28, a rectangular down-link waveguide leg 34 configured as a receive reject filter (RRF) and a rectangular up-link waveguide leg 36 configured as a transmit reject filter (TRF). The waveguide legs 34 and 36 represent orthogonally polarized signal ports, for example, left hand circularly polarized (LHCP) and right hand circularly polarized (RHCP) ports. The waveguide legs 34 and 36 include corrugations that only allow certain frequencies to propagate so that the RRF does not allow the up-link signals to pass and the TRF does not allow down-link signals to pass. In other words, the RRF and the TRF are selectively designed so that there is no interference between the up-link and down-link signals, especially for the down-link signal which is at high power and could overwhelm the low noise amplifiers in the receiver architecture. The waveguide legs 34 and 36 are isolated by more than 20 dB, which also provides additional isolation of the up-link and down-link channels. In an alternate embodiment, the polarizer 28 can be fabricated in combination with the waveguide 32 and the feed horn 12 as one continuous piece so that the flanges 30 can be eliminated.

Figure 4:
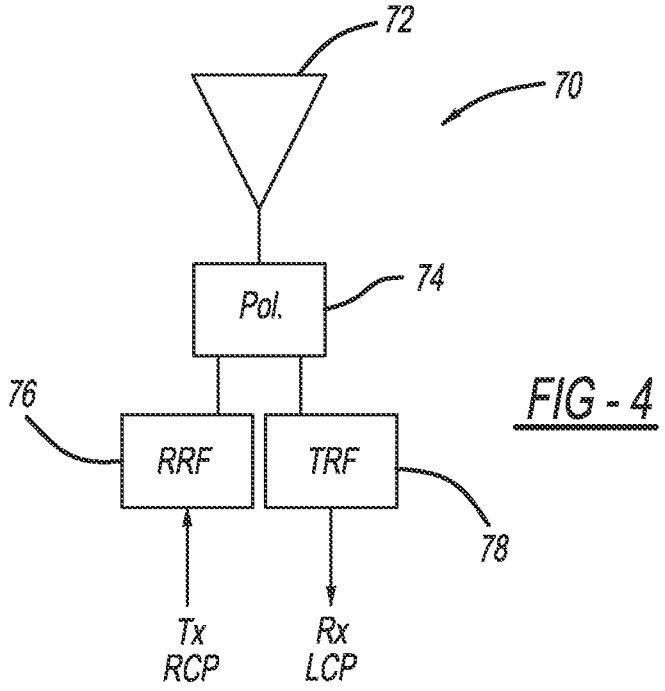
FIG. 4 is a schematic block diagram of the feed horn assembly shown in FIG. 3.

FIG. 4 is a block diagram 70 of the feed horn assembly 24, where antenna 72 represents the feed horn 12, polarizer 74 represents the polarizer 28, RRF 76 represents the down-link waveguide leg 34 and TRF 78 represents the up-link waveguide leg 36. In this embodiment, the transmit or down-link signal Tx is shown being applied to the RRF 76 as a right circularly polarized (RCP) signal and the receive or up-link signal Rx is shown as a left circularly polarized (LCP) signal.

An RF circuit board 60 is mounted on top of the base plate 22 within the enclosure defined by the struts 20 and supports a number of RF modules 62 configured thereon, where each module 62 includes the various electrical circuits, such as low noise amplifiers (LNA) for the up-link signal, solid state power amplifiers (SSPA) for the down-link signal, down-converters, up-converters, mixers, digital hardware, etc., for the transmit signals or the receive signals for each of the feed horns 12. Each of the down-link waveguide legs 34 and the up-link waveguide legs 36 are electromagnetically coupled to a specific one of the modules 62 through a flexible transition waveguide 64 by a flange 58, where the transition waveguide 64 has a length, configuration, etc. that allows the feed assembly 14 to be compact for the particular application.

Figure 5:
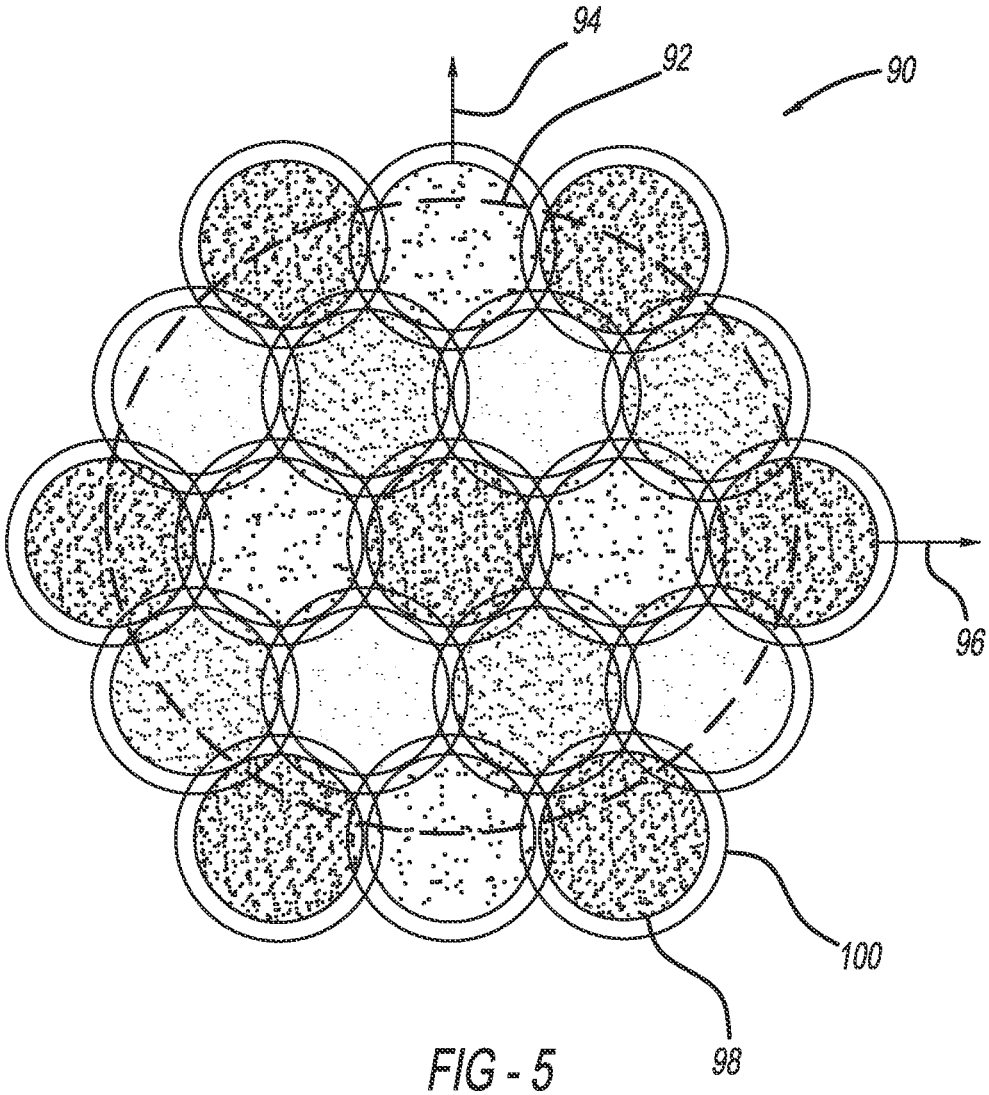
FIG. 5 is an illustration of a multi-beam layout on the ground for the antenna system shown in FIG. 1.

FIG. 5 is an illustration 90 showing the beam layout on the Earth for each of the beams provided by the feed horns 12. In the illustration 90, dotted circle 92 represents the profile of the Earth from the altitude that the satellite is orbiting, such as 800 km and having a 46° diameter, line 94 represents the elevation direction and line 96 represents the azimuth direction. Each circle or cell 98 represents the beam diameter for the beam of a separate one of the feed horns 12 on the Earth, where each cell 98 that is shaded in the same manner represents a particular frequency range in the frequency band of interest so that the same frequency band for two of the different feed horns 12 are not contiguous with each other on the ground. This allows different information or data to be transmitted at the same frequency and at the same time without the signals interfering with each other. In this embodiment, one set of four of the feed horns 12 operate at a first frequency band, a second set of four of the feed horns 12 operate at a second frequency band, a third set of four of the feed horns 12 operate at a third frequency band, and a fourth set of seven of the feed horns 12 operate at a fourth frequency band, where the four frequency bands are contiguous with each other. Larger circles 100 represent coverage cells including the pointing error of the satellite, where the actual feed beam of the horn 12 represented by the circle 98 may fall anywhere within the circle 100.

In one non-limiting embodiment, the down-link signals are within one of four frequency channels in the frequency range of 10.7-12.7 GHz, where down-link channel D1 is in the frequency band 10.7-11.2 GHz, down-link channel D2 is in the frequency band 11.2-11.7 GHz, down-link channel D3 is in the frequency band 11.7-12.2 GHz, and down-link channel D4 is in the frequency band 12.2-12.7 GHz, and where each group of commonly shaded cells 98 provides the same frequency band channel. In this embodiment, there are two up-link frequency channels U1 and U2, where up-link channel U1 includes frequency band 12.75-13.25 GHz and up-link channel U2 includes frequency band 14.00-14.5 GHz.

As discussed, the feed horns 12 are used for both the up-link and down-link signals. In a base line embodiment, those feed horns 12 that operate at the down-link channels D1, D2 and D3 are also used for the up-link channel U1 and those feed horns 12 that operate at the down-link channel D4 are also used for the up-link channel U2. In another embodiment, those feed horns 12 that operate at the down-link channel D1 are also used for the up-link channel U1 and those frequency horns 12 that operate at the down-link channels D2, D3 and D4 are also used for the up-link channel U2.

TABLE 1 below illustrates the performance of the feed horns 12 for this embodiment.

TABLE 1

| Freq., GHz | Return Loss, dB | X-pol Peak, dB | Directivity Comp (dBi) |
|---|---|---|---|
| 10.95 | 25.2 | −24 | 24.92 |
| 11.45 | 32.0 | −29 | 25.88 |
| 11.95 | 23.4 | −30 | 26.66 |
| 12.45 | 26.2 | −28 | 26.91 |
| 13.00 | 35.2 | −33 | 26.92 |
| 14.25 | 35.1 | −27 | 27.02 |

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An integrated antenna system for a satellite, said antenna system comprising:

a support structure including a base plate and a strut assembly mounted to the base plate and defining an enclosure, said support structure further including an alignment plate mounted to the strut assembly opposite to the base plate;

a plurality of feed horns mounted to the alignment plate in a rigid manner so that each feed horn has a predetermined pointing direction, each feed horn including a plurality of tapered sections defining transitions therebetween that support propagation modes for both up-link signals and down-link signals, each feed horn further including an input end and an aperture end, wherein a down-link frequency band for the down-link signals is separated into four separate frequency channels and an up-link frequency band for the up-link signals is separated into two separate frequency channels, where a plurality of the plurality of feed horns operate at the frequency for a particular frequency channel and where the feed horns operating at the same down-link frequency channel are not adjacent to each other;

a plurality of septum polarizers where a separate septum polarizer is coupled to the input end of each feed horn, each septum polarizer converting circularly polarized signals to linearly polarized signals for the up-link signals received by the feed horn and converting linearly polarized signals to circularly polarized signals for the down-link signals to be transmitted by the feed horn;

a Y-shaped waveguide including a polarizer port, a transmit leg and a receive leg, said polarizer port being coupled to the septum polarizer opposite to the feed horn, wherein the receive leg includes a transmit reject filter for selectively passing the up-link signals and rejecting the down-link signals and the transmit leg includes a receive reject filter for selectively passing the down-link signals and rejecting the up-link signals;

an RF circuit board mounted on the base plate within the enclosure and including a plurality of RF modules for processing the up-link and down-link signals; and a plurality of flex waveguides where a separate flex waveguide is coupled to the receive leg of each Y-shaped waveguide and one of the RF modules and coupled to the transmit leg of each Y-shaped waveguide and one of the RF modules to direct the down-link signals from the RF module to the transmit leg and direct the up-link signals from the receive leg to the RF module.

2. The antenna system according to claim 1 wherein the mechanical support structure is a die-cast aluminum structure.

3. The antenna system according to claim 1 wherein the feed horn and the septum polarizer are a single formed piece.

4. The antenna system according to claim 1 wherein the feed horn, the septum polarizer and the waveguide filter are a single formed piece.

5. The antenna system according to claim 1 wherein the plurality of feed horns is nineteen feed horns.

6. The antenna system according to claim 1 wherein the down-link frequency band is 10.7-12.7 GHz and a first down-link frequency channel is 10.7-11.2 GHz, a second down-link frequency channel is 11.2-11.7 GHz, a third down-link frequency channel is 11.7-12.2 GHz, and a fourth down-link frequency channel is 12.2-12.7 GHz.

7. The antenna system according to claim 6 wherein the up-link frequency band includes a first up-link frequency channel at 12.75-13.25 and a second up-link frequency channel at 14.00-14.50.

8. The antenna system according to claim 7 wherein the feed horns that operate at the first, second and third down-link frequency channels also operate at the first up-link frequency channel and the fourth down-link frequency channel operates at the second up-link frequency channel.

9. The antenna system according to claim 7 wherein the feed horns that operate at the first down-link frequency channel also operate at the first up-link frequency channel and the feed horns that operate at the second, third and fourth down-link frequency channels also operate at the second up-link frequency channel.

10. The antenna system according to claim 1 wherein the antenna system is mounted on a low Earth orbit satellite.

11. A diplexed multiple beam integrated antenna system comprising:

a plurality of feed horns mounted to an alignment plate so that each feed horn has a predetermined pointing direction, each feed horn including a plurality of tapered sections defining transitions therebetween that support multiple propagation modes, each feed horn further including an input end and an aperture end;

a plurality of polarizers where a separate polarizer is coupled to the input end of each feed horn, each polarizer converting circularly polarized signals to linearly polarized signals for receive signals received by the feed horn and converting linearly polarized signals to circularly polarized signals for transmit signals to be transmitted by the feed horn, wherein a transmit frequency band for the transmit signals is separated into four separate frequency channels and a receive frequency band for the receive signals is separated into two separate frequency channels, where a plurality of the plurality of feed horns operate at the frequency for a particular frequency channel and where the feed horns operating at the same transmit frequency channel are not adjacent to each other;

a filter waveguide including a polarizer port, a transmit leg and a receive leg, where the transmit leg and the receive leg are isolated by more than 20 dB, said polarizer port being coupled to the polarizer opposite to the feed horn, wherein the receive leg includes a transmit reject filter for selectively passing the receive signals and rejecting the transmit signals and the transmit leg includes a receive reject filter for selectively passing the transmit signals and rejecting the receive signals;

an RF circuit board including a plurality of RF modules for processing the receive and transmit signals;

a plurality of flex waveguides where a separate flex waveguide is coupled to the receive leg of each filter waveguide and one of the RF modules and the transmit leg of each filter waveguide and one of the RF modules to direct the transmit signals from the RF module to the transmit leg and direct the receive signals from the receive leg to the RF module; and a combination of a septum polarizer with isolated ports and the filters providing the desired isolation between the up-link and down-link RF signals.

12. The antenna system according to claim 11 wherein the feed horn and the polarizer are a single formed piece.

13. The antenna system according to claim 11 wherein the feed horn, the polarizer and the waveguide filter are a single formed piece.

14. The antenna system according to claim 11 wherein the plurality of feed horns is nineteen feed horns.

15. The antenna system according to claim 11 wherein the antenna system is mounted on a low Earth orbit satellite.

16. An integrated antenna system for a low earth orbit (LEO) satellite, said antenna system comprising:

a support structure including a base plate and a strut assembly mounted to the base plate and defining an enclosure, said support structure further including an alignment plate mounted to the strut assembly opposite to the base plate;

nineteen feed horns mounted to the alignment plate in a rigid manner so that each feed horn has a predetermined pointing direction, each feed horn including a plurality of tapered sections defining transitions therebetween that support propagation modes for both up-link signals and down-link signals, each feed horn further including an input end and an aperture end, wherein a down-link frequency band for the down-link signals is separated into four separate frequency channels and an up-link frequency band for the up-link signals is separated into two separate frequency channels, where a plurality of the feed horns operate at the frequency for a particular frequency channel and where the feed horns operating at the same down-link frequency channel are not adjacent to each other;

a plurality of septum polarizers where a separate septum polarizer is coupled to the input end of each feed horn, each septum polarizer converting linearly polarized signals to circularly polarized signals for the up-link signals received by the feed horn and converting circularly polarized signals to linearly polarized signals for the down-link signals to be transmitted by the feed horn;

a Y-shaped waveguide including a polarizer port, a transmit leg and a receive leg, said polarizer port being coupled to the septum polarizer opposite to the feed horn, wherein the receive leg includes a transmit reject filter for selectively passing the up-link signals and rejecting the down-link signals and the transmit leg includes a receive reject filter for selectively passing the down-link signals and rejecting the up-link signals;

an RF circuit board mounted on the base plate within the enclosure and including a plurality of RF modules for processing the up-link and down-link signals; and a plurality of flex waveguides where a separate flex waveguide is coupled to the receive leg of each Y-shaped waveguide and one of the RF modules and coupled to the transmit leg of each Y-shaped waveguide and one of the RF modules to direct the down-link signals from the RF module to the transmit leg and direct the up-link signals from the receive leg to the RF module.

17. The antenna system according to claim 16 wherein the down-link frequency band is 10.7-12.7 GHz and a first down-link frequency channel is 10.7-11.2 GHz, a second down-link frequency channel is 11.2-11.7 GHz, a third down-link frequency channel is 11.7-12.2 GHz, and a fourth down-link frequency channel is 12.2-12.7 GHz, and the up-link frequency band includes a first up-link frequency channel at 12.75-13.25 and a second up-link frequency channel at 14.00-14.50.

18. The antenna system according to claim 17 wherein the feed horns that operate at the first down-link frequency channel also operate at the first up-link frequency channel and the feed horns that operate at the second, third and fourth down-link frequency channels also operate at the second up-link frequency channel.

* * * * *